US010580368B2

(12) United States Patent
Lo et al.

(10) Patent No.: US 10,580,368 B2
(45) Date of Patent: Mar. 3, 2020

(54) COLOR REFLECTIVE DISPLAY DEVICE AND OPERATING METHOD THEREOF

(71) Applicant: E Ink Holdings Inc., Hsinchu (TW)

(72) Inventors: Po-Yuan Lo, Hsinchu (TW); Tai-Yuan Lee, Hsinchu (TW); Pei-Lin Huang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 1189 days.

(21) Appl. No.: 14/306,252

(22) Filed: Jun. 17, 2014

(65) Prior Publication Data

US 2015/0138246 A1 May 21, 2015

(30) Foreign Application Priority Data

Nov. 15, 2013 (TW) ..... 102141706 A

(51) Int. Cl.
*G09G 3/36* (2006.01)

(52) U.S. Cl.
CPC ..... *G09G 3/3607* (2013.01)

(58) Field of Classification Search
CPC .... G09G 3/3607; G09G 3/3433; G09G 3/344; G09G 3/3446
See application file for complete search history.

(56) References Cited

U.S. PATENT DOCUMENTS 8,659,540 B2 * 2/2014 Wang ..... G09G 3/344 345/107
2002/0180688 A1 * 12/2002 Drzaic ..... B41J 3/4076 345/107
2007/0064302 A1 * 3/2007 Johnson ..... G02F 1/167 359/296
2009/0273827 A1 * 11/2009 Lin ..... G09G 3/3446 359/296
2010/0001946 A1 * 1/2010 Murayama ..... G02F 1/167 345/107

(Continued)

FOREIGN PATENT DOCUMENTS

CN 1871547 A 11/2006
JP 2009251032 A 10/2009

(Continued)

OTHER PUBLICATIONS

English Translation and Drawings for JP 2009251032.*

(Continued)

*Primary Examiner* — Nelson M Rosario
*Assistant Examiner* — Eboni N Giles
(74) *Attorney, Agent, or Firm* — CKC & Partners Co., LLC

(57) ABSTRACT

A color reflective display device includes a plurality of color sub-pixels and a control circuit. The control circuit is configured to provide a first driving signal to at least one of a plurality of mini-pixels of a first color sub-pixel, such that the at least one of mini-pixels receiving the first driving signal displays a first color, provide a second driving signal to another at least one of the mini-pixels of the first color sub-pixel, such that the another at least one of the mini-pixels receiving the second driving signal displays a second color, and provide a third driving signal to a second color sub-pixel of the color sub-pixels, such that the second color sub-pixel displays a third color.

20 Claims, 8 Drawing Sheets

(56) References Cited

U.S. PATENT DOCUMENTS

| | | | | |
|---|---|---|---|---|
| 2012/0139963 | A1* | 6/2012 | Lee | G09G 3/344 345/690 |
| 2012/0268502 | A1* | 10/2012 | Kurasawa | G09G 3/3648 345/690 |
| 2012/0280958 | A1* | 11/2012 | Lee | G09G 3/344 345/211 |
| 2014/0340734 | A1* | 11/2014 | Lin | G09G 3/344 359/296 |
| 2015/0009552 | A1* | 1/2015 | Kitazawa | G02F 1/167 359/296 |
| 2015/0213764 | A1* | 7/2015 | Kitazawa | G02F 1/167 345/694 |
| 2016/0041448 | A1* | 2/2016 | Lin | G02F 1/167 359/296 |
| 2016/0293111 | A1* | 10/2016 | Lin | G09G 3/344 |
| 2017/0025072 | A1* | 1/2017 | Lin | G09G 3/344 |

FOREIGN PATENT DOCUMENTS

| | | | |
|---|---|---|---|
| TW | 200525268 | A | 8/2005 |
| TW | 201237528 | A | 9/2012 |
| TW | 201326975 | A | 7/2013 |
| TW | 201346414 | A | 11/2013 |

OTHER PUBLICATIONS

English Translation of TW 201326975.*
Corresponding Taiwanese Office Action that these art references were cited dated Nov. 2, 2015.
Corresponding Chinese Office Action that this art reference was cited dated Aug. 18, 2016.

* cited by examiner

COLOR REFLECTIVE DISPLAY DEVICE AND OPERATING METHOD THEREOF

RELATED APPLICATIONS

This application claims priority to Taiwanese Application Serial Number 102141706, filed Nov. 15, 2013, which is herein incorporated by reference.

BACKGROUND

Field of Invention

The present disclosure relates to an electronic apparatus and an operating method thereof. More particularly, the present invention relates to a color reflective display device and an operating method thereof.

Description of Related Art

With advances in display technology, display devices are widely used in various kinds of electronic devices, such as mobile phones, tablet computers, and e-paper devices.

A typical color reflective display device includes red, green, blue color filters and a reflective display layer. The reflective display layer is disposed under the color filters, and is configured to selectively reflect lights passing through the color filters, so as to make the color reflective display device display an image.

When a color reflective display device has color filters with high pixel fill factors (PFFs), the image of the color reflective display device has a high color saturation and a low reflectivity. When the ambient light is strong, the image of such a color reflective display device has a good color quality. When the ambient light is weak, the image of such a color reflective display device is limited in its ability to reflect light.

Moreover, when the color reflective display device has color filters with low PFFs, the image of the color reflective display device has a low color saturation and a high reflectivity. When the ambient light is strong, the image of such a color reflective display device is able to reflect light well, but poor color quality in either case.

Thus, in order to allow for more widespread use of the color reflective display device, a color reflective display device having images with a high color saturation and a high reflectivity is desired.

SUMMARY

One aspect of the present disclosure is related to a color reflective display device. In accordance with one embodiment of the present disclosure, the color reflective display device includes a plurality of color sub-pixels and a control circuit. The first color sub-pixel of the color sub-pixels includes a plurality of mini-pixels. The control circuit is configured to, in a first operating state, provide a first driving signal to at least one of the mini-pixels of the first color sub-pixel, such that the at least one of the mini-pixels of the first color sub-pixel receiving the first driving signal displays a first color according to the first driving signal; provide a second driving signal to another at least one of the mini-pixels of the first color sub-pixel, such that the another at least one of the mini-pixels of the first color sub-pixel receiving the second driving signal displays a second color different from the first color according to the second driving signal; and provide a third driving signal to a second color sub-pixel of the color sub-pixels, such that the second color sub-pixel displays a third color according to the third driving signal.

In accordance with one embodiment of the present disclosure, a reflectivity of a fourth color mixed by the first color, the second color, and the third color is higher than a reflectivity of the third color.

In accordance with one embodiment of the present disclosure, a third color sub-pixel of the color sub-pixels includes a plurality of mini-pixels. The control circuit is configured to, in the first operating state, provide the first driving signal to at least one of the mini-pixels of the third color sub-pixel, such that the at least one of the mini-pixels of the third color sub-pixel receiving the first driving signal displays a fifth color according to the first driving signal; and provide the second driving signal to another at least one of the mini-pixels of the third color sub-pixel, such that the another at least one of the mini-pixels of the third color sub-pixel receiving the second driving signal displays a sixth color different from the fifth color according to the second driving signal.

In accordance with one embodiment of the present disclosure, the first color is one of red, green, and blue, the second color is another one of red, green, and blue, and the third color is the remaining one of red, green, and blue.

In accordance with one embodiment of the present disclosure, the first color sub-pixel is a green sub-pixel, the second color sub-pixel is one of a red sub-pixel and a blue sub-pixel, and the third color sub-pixel is another one of the red sub-pixel and the blue sub-pixel.

In accordance with one embodiment of the present disclosure, in a situation where there is more than one of the mini-pixels receiving the first driving signal, the mini-pixels receiving the first driving signal are evenly disposed in the first color sub-pixel.

In accordance with one embodiment of the present disclosure, the control circuit is configured to, in a second operating state, provide the first driving signal to at least one of the mini-pixels of the first color sub-pixel, such that the at least one of the mini-pixels of the first color sub-pixel receiving the first driving signal displays the first color according to the first driving signal. A number of the mini-pixel receiving the first driving signal in the first operating state is different from a number of the mini-pixel receiving the first driving signal in the second operating state, such that a reflectivity of a fourth color mixed by the first color, the second color, and the third color in the first operating state is different from a reflectivity of a seventh color mixed by the first color, the second color, and the third color in the second operating state.

In accordance with one embodiment of the present disclosure, the control circuit is configured to determine whether to function in the first operating state or the second operating state according to an ambient light.

In accordance with one embodiment of the present disclosure, the control circuit is further configured to provide a fourth driving signal to a fourth color sub-pixel during providing the first driving signal and the second driving signal to the first color sub-pixel, such that the fourth color sub-pixel displays an eighth color according to the fourth driving signal.

In accordance with one embodiment of the present disclosure, the eighth color is white.

Another aspect of the present disclosure is related to an operating method of a color reflective display device. In accordance with one embodiment of the present disclosure, the color reflective display device includes a first color sub-pixel. The first color sub-pixel includes a plurality of mini-pixels. The operating method includes providing, in a first operating state, a first driving signal to at least one of the mini-pixels of the first color sub-pixel, such that the at least one of the mini-pixels of the first color sub-pixel receiving the first driving signal displays a first color according to the first driving signal; providing, in the first operating state, a second driving signal to another at least one of the mini-pixels of the first color sub-pixel, such that the another at least one of the mini-pixels of the first color sub-pixel receiving the second driving signal displays a second color different from the first color according to the second driving signal; and providing, in the first operating state, a third driving signal to a second color sub-pixel of the color sub-pixels, such that the second color sub-pixel displays a third color according to the third driving signal.

In accordance with one embodiment of the present disclosure, a reflectivity of a fourth color mixed by the first color, the second color, and the third color is higher than a reflectivity of the third color.

In accordance with one embodiment of the present disclosure, a third color sub-pixel of the color sub-pixels includes a plurality of mini-pixels. The operating method includes providing, in the first operating state, the first driving signal to at least one of the mini-pixels of the third color sub-pixel, such that the at least one of the mini-pixels of the third color sub-pixel receiving the first driving signal displays a fifth color according to the first driving signal; and providing, in the first operating state, the second driving signal to another at least one of the mini-pixels of the third color sub-pixel, such that the another at least one of the mini-pixels of the third color sub-pixel receiving the second driving signal displays a sixth color different from the fifth color according to the second driving signal.

In accordance with one embodiment of the present disclosure, the first color is one of red, green, and blue, the second color is another one of red, green, and blue, and the third color is the remaining one of red, green, and blue.

In accordance with one embodiment of the present disclosure, the first color sub-pixel is a green sub-pixel, the second color sub-pixel is one of a red sub-pixel and a blue sub-pixel, and the third color sub-pixel is another one of the red sub-pixel and the blue sub-pixel.

In accordance with one embodiment of the present disclosure, in a situation where there is more than one of the mini-pixels receiving the first driving signal, the mini-pixels receiving the first driving signal are evenly disposed in the first color sub-pixel.

In accordance with one embodiment of the present disclosure, the operating method further includes providing, in a second operating state, the first driving signal to at least one of the mini-pixels of the first color sub-pixel, such that the at least one of the mini-pixels of the first color sub-pixel receiving the first driving signal displays the first color according to the first driving signal. A number of the mini-pixel receiving the first driving signal in the first operating state is different from a number of the mini-pixel receiving the first driving signal in the second operating state, such that a reflectivity of a fourth color mixed by the first color, the second color, and the third color in the first operating state is different from a reflectivity of a seventh color mixed by the first color, the second color, and the third color in the second operating state.

In accordance with one embodiment of the present disclosure, whether to function in the first operating state or the second operating state is determined according to an ambient light.

In accordance with one embodiment of the present disclosure, the operating method further includes providing a fourth driving signal to a fourth color sub-pixel during providing the first driving signal and the second driving signal to the first color sub-pixel, such that the fourth color sub-pixel displays an eighth color according to the fourth driving signal.

In accordance with one embodiment of the present disclosure the eighth color is white.

Through an application of one embodiment described above, a color reflective display device can be realized By using a portion of the mini-pixels of the first color sub-pixel to display the first color when the second color sub-pixel displays the third color, the brightness and reflectivity of the color displayed by the color reflective display device can be increased. Thus, even if the color reflective display device has color filters with high PFFs, such a color reflective display device can still display an image with a high reflectivity.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
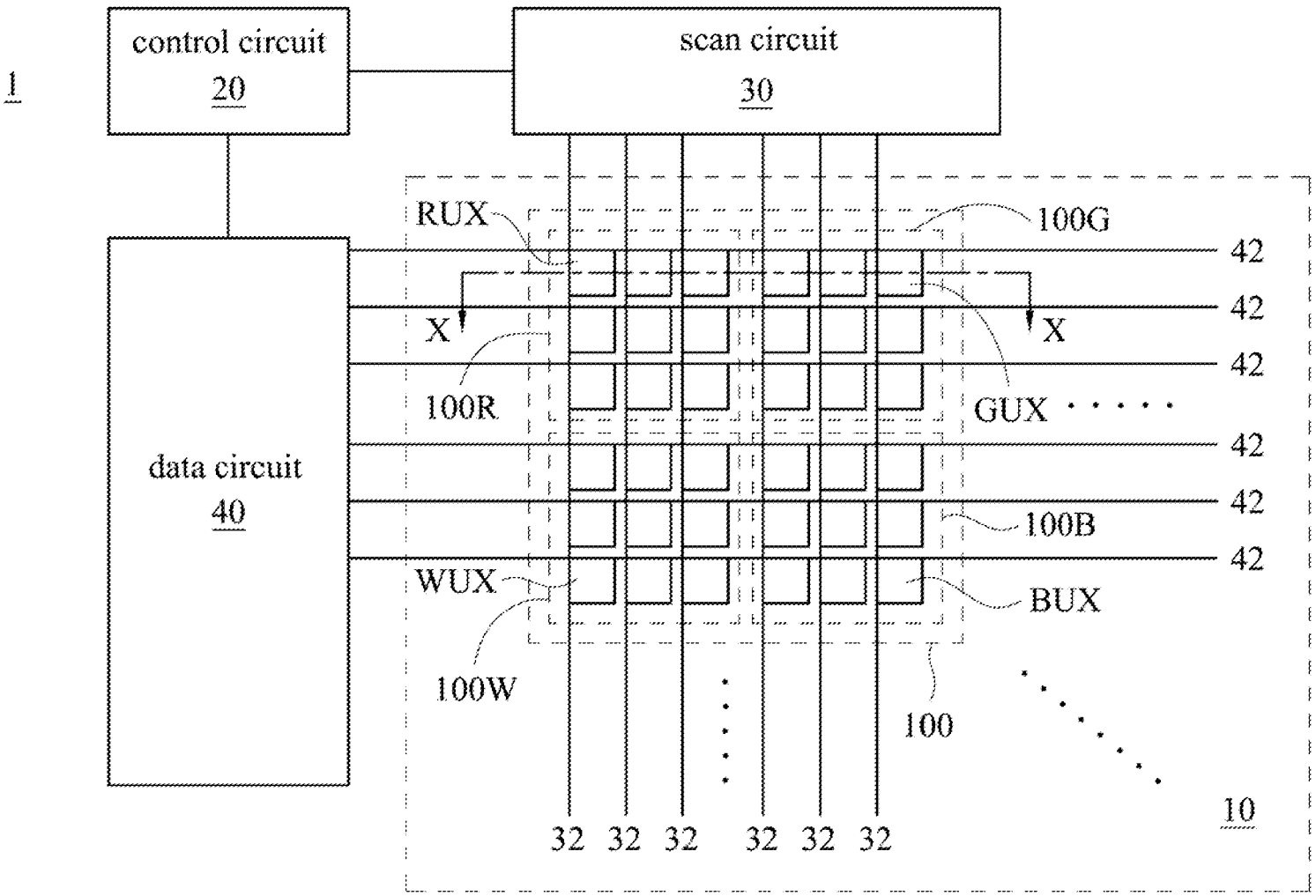
FIG. 1 is a schematic diagram of a color reflective display device in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, although the terms first, second, etc, may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, words indicating direction used in the description of the following embodiments, such as "above," "below," "left," "right," "front" and "back," are directions as they relate to the accompanying drawings. Therefore, such words indicating direction are used for illustration and do not limit the invention.

It will be understood that, in the description herein and throughout the claims that follow, the phrase "and/or" includes any and all combinations of one or more of the associated listed items.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

One aspect of the present disclosure is related to a color reflective display device. Although this color reflective display device has color filters with high PFFs, it can still display an image with a high reflectivity.

Table 1 below illustrates CIE color coordinate values (i.e., L*, a*, b*) corresponding to colors displayed by typical color reflective display devices under a CIE standard illuminant D65 (e.g., with color temperature 6500K).

TABLE 1

| | PFF | L* | a* | b* |
|---|---|---|---|---|
| 1 | 87 | 27.81 | −17.83 | 11.5 |
| 2 | 87 | 41.5 | −12.71 | 6.97 |
| 3 | 68 | 43.17 | −10.39 | 5.31 |

In the first row of Table 1, chromatic characteristics of a color reflective display device which has color filters (e.g., green color filters) with PFFs 87 are illustrated. When this color reflective display device displays a normal green color (that is, green sub-pixels thereof display green colors, and other sub-pixels thereof, such as red sub-pixels, blue sub-pixels, and white sub-pixels display black colors), the CIE color coordinate values corresponding to this normal green color are measured as a*=−17.83, b*=11.5, and L*=27.81.

In the second row of Table 1, chromatic characteristics of the same color reflective display device displaying a light green color are illustrated. At this time, the green sub-pixels of the reflective display device display green colors, the white sub-pixels of the reflective display device display white colors, and other sub-pixels thereof, such as the red sub-pixels and the blue sub-pixels, display black colors. The CIE color coordinate values corresponding to this light green color are measured as a*=−12.71, b*=6.97, and L*=41.5.

It is noted that the CIE color coordinates a* and b* relate to the color saturation of an image. The smaller the CIE color coordinates a* and the greater CIE color coordinate b*, the higher the color saturation of the image, and vice versa. In addition, CIE color coordinate L* relates to the reflectivity of an image. The greater the CIE color coordinate L*, the higher the reflectivity of the image, and vice versa. Hence, as illustrated in the first and second rows of Table 1, when this color reflective display device is switched from displaying the normal green color to displaying the light green color, the reflectivity of the image displayed by this color reflective display device is increased, but the color saturation of this image is decreased.

Moreover, in the third row of Table 1, chromatic characteristics of a color reflective display device which has color filters (e.g., green color filters) with PFFs 68 are illustrated. When this color reflective display device displays a light green color (that is, green sub-pixels thereof display green colors, white sub-pixels thereof display white colors, and other sub-pixels thereof, such as red sub-pixels and blue sub-pixels, display black colors), the CIE color coordinate values corresponding to this light green color are measured as a*=−10.86, b*=5.31, and L*=43.17.

The reflectivity corresponding to the CIE color coordinate value L* in the third row of Table 1 is higher than the reflectivity corresponding to the CIE color coordinate value L* in the second row of Table 1. However, the color saturation corresponding to the CIE color coordinate values a* and b* in the third row of Table 1 is lower than the color saturation corresponding to the CIE color coordinate values a* and b* in the second row of Table 1. That is, when a color reflective display device's color filters with PFFs 87 (corresponding to the second row of Table 1) are changed to color filters with PFFs 68 (corresponding to the third row of Table 1), the reflectivity of the image of this color reflective display is increased, but the color saturation of the same is decreased.

Thus, one aspect of the present disclosure provides a color reflective display device. The reflectivity of the image of this color reflective display device can be increased without changing the color filters of this color reflective to color filters having lower PFFs, and the color saturation of the image of this color reflective display device can be maintained at a high level.

Figure 2:
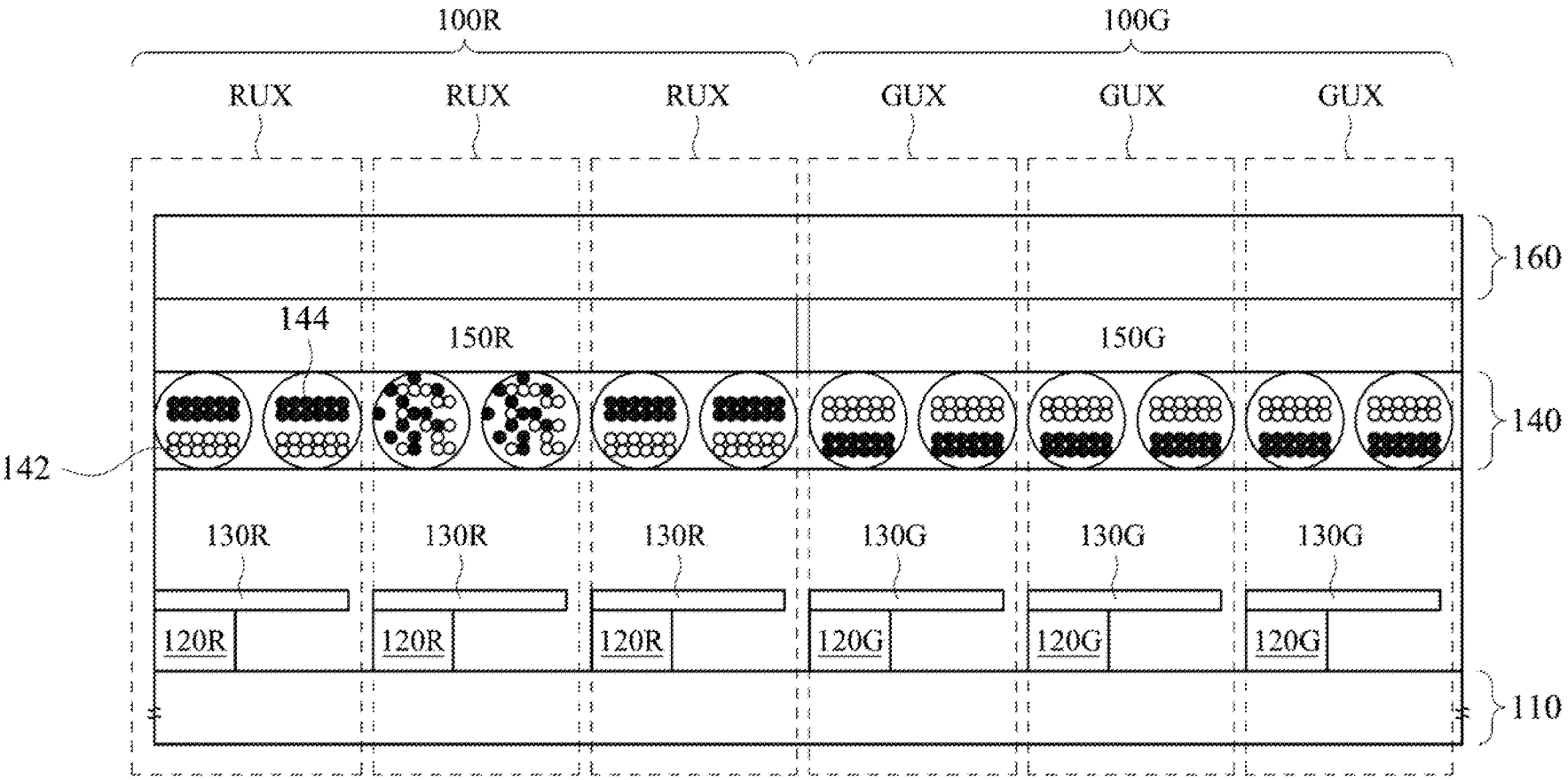
FIG. 2 is a cross-sectional view of the color reflective display device in FIG. 1 taken along line X-X.

Reference is now made to FIG. 1 and FIG. 2. FIG. 1 is a schematic diagram of a color reflective display device 1 in accordance with one embodiment of the present disclosure. In this embodiment, the color reflective display device 1 includes a display matrix 10, a control circuit 20, a scan circuit 30, a plurality of scan lines 32, a data circuit 40, and a plurality of data lines 42. The display matrix 10 includes a plurality of pixels 100 arranged in an array. Each of the pixels 100 includes a plurality of color sub-pixels (e.g., a red sub-pixel 100R, a green sub-pixel 100G, a blue sub-pixel 1006, and a white sub-pixel 100W.

In this embodiment, each of the color pixels 100R, 100G, 100G, 100W includes a plurality of mini-pixels RUX, GUX, BUX, WUX arranged in arrays. Each of the mini-pixels RUX, GUX, BUX, WUX is electrically connected to one of the scan lines 32 and one of the data lines 42. It is noted that, in this embodiment, each of the color pixels 100R, 100G, 100B, 100W has 9 mini-pixels RUX, GUX, BUX, WUX, and such a configuration is taken as an illustrative example. However, in practice, the number of the mini-pixels RUX, GUX, BUX, WUX can be varied on the basis of actual requirements, and is not limited to the number disclosed herein.

FIG. 2 is a cross-sectional view of the color reflective display device in FIG. 1 taken along line X-X. In the embodiment below, the mini-pixels RUX in one of the red sub-pixels 100R will be taken as a descriptive example. Each of the mini-pixels RUX includes a substrate 110, a switch 120R, a pixel electrode 1308, a reflective display layer 140, a color filter (e.g., a red color filter) 150R, and a protective layer 160. The switch 120R is disposed on the substrate 110, and is electrically connected to one of the scan lines 32, one of the data lines 42, and the pixel electrode 130R. The color filter 150R is located above the pixel electrode 130R, and only red light can pass through the color filter 150R. The protective layer 160 is located on the color filter 150R. The reflective display layer 140 is interposed between the color filter 150R and the pixel electrode 130R, and has a plurality of white particles 142 and dark particles 144 with different electric charges (e.g., positive or negative electric charges). It is noted that the structures of the mini-pixels RUX in this embodiment are similar to the structure of a typical red sub-pixel. However, one mini-pixel RUX in this embodiment is merely a portion of one red sub-pixel 100R in this embodiment. In other words, one red sub-pixel 100R in this embodiment has a plurality of mini-pixels RUX, in which the structures of the mini-pixels RUX are similar to the structure of a typical red sub-pixel.

In this embodiment, the switches 1208 and the pixel electrodes 130R in the mini-pixels RUX of one red sub-pixel 100R are independent from each other. In addition, all of the color filters 150R in the mini-pixels RUX of one red sub-pixel 100R may be implemented by one color filter. In other words, under the condition that one red sub-pixel 100R includes 9 mini-pixels RUX, the red sub-pixel 100R includes 9 independent switches 120R, 9 independent pixel electrodes 130R, and one color filter 150R. In addition, in this embodiment, the color filter 150R has a high PFF. In one embodiment, the PFF of the color filter 150R is greater than 60.

In this embodiment, the mini-pixels GUX in the green sub-pixels 100G and the mini-pixels BUX in the blue sub-pixels 100B have structures similar to the structures of the mini-pixels RUX in the red sub-pixels 100R, and a description in this regard will not be repeated herein. In one embodiment, the mini-pixels WUX in the white sub-pixels 100W have no color filter, but other structural aspects of the mini-pixels WUX are still similar to those of the mini-pixels RUX in the red sub-pixels 100R, and a description in this regard will not be repeated herein.

In this embodiment, the control circuit 20 is configured to provide driving signals (e.g., including data signals and scan signals) to the display matrix 10 through the scan circuit 30 and the data circuit 40 via the scan lines 32 and the data lines 42, such that the pixels 10, sub-pixels 100R, 100G, 100B, 100W, and mini-pixels RUX, GUX, BUX, WUX display colors according to the driving signals.

More specifically, in this embodiment, the scan circuit 30 is configured to provide scan signals to the display matrix 10 through the scan lines 32, so as to cause the switches 120R, 120G, 120B, 120W of the mini-pixels RUX, GUX, BUX, WUX to turn on. The data circuit 40 is configured to provide data signals to the display matrix 10 through the data lines 42 and the turned on switches 120R, 120G, 120B, 120W, so as to provide the data signals to the pixel electrodes 130R, 130G, 130B, 130W coupled to the switches 120R, 120G, 120B, 120W. Upon reception of the data signals, the pixel electrodes 130R, 130G, 130B, 130W have voltage levels corresponding to the data signals, and accordingly attract white particles 142 or dark particles 144 in corresponding portions of the reflective display layer 140, so as to make the corresponding portions of the reflective display layer 140 display brightness corresponding to certain grayscales. With such an operation, when lights with certain colors pass through the color filters 150R, 150G, 150B, 150W, the reflective display layer 140 can reflect, partly reflect, or absorb the incoming lights according to the white particles 142 and/or the dark particles on the viewing surface of the reflective display layer 140 (e.g., a surface adjacent to the color filters 150R, 150G, 150B, 150W). Through such a configuration, the pixels 100, the color sub-pixels 100R, 100G, 100G, 100W, and the mini-pixels RUX, GUX, BUX, WUX can display colors.

It should be noted that the phrase "grayscale" mentioned above indicates a degree from dark to light. In the description herein, a grayscale with 16 levels is taken as a descriptive, for example, in which "grayscale 0" indicates the darkest level and "grayscale 15" indicates the lightest level. However, the disclosure is not limited to such an example.

In the following paragraph, more details are provided with reference to FIG. 3A, but the disclosure is not limited to the embodiment below. To facilitate the description to follow, an x-axis and a y-axis in an x-y rectangular coordinate system will be used as reference to describe the mire-pixels RUX, GUX, BUX, WUX in the color sub-pixels 100R, 100G, 100B, 100W of the pixel 100. For example, the mini-pixels RUX in the red sub-pixel 100R are located at positions corresponding to coordinates from (0, 0) to (−3, 3), the mini-pixels GUX in the green sub-pixel 100G are located at locations corresponding to coordinates from (0, 0) to (3, 3), the mini-pixels BUX in the blue sub-pixel 100B are located at locations corresponding to coordinates from (0, 0) to (3, −3), and the mini-pixels WUX in the white sub-pixel 100W are located at locations corresponding to coordinates from (0, 0) to (−3, −3).

In one embodiment, to make the pixel 100 display a green color with high brightness, the control circuit 20 can provide third driving signals to all of the mini-pixels GUX in the green sub-pixel 100G, so as to make a portion of the reflective display layer corresponding to the mini-pixels GUX display a white color (e.g., the white particles are located at the viewing surface), and make all of the mini-pixels GUX in the green sub-pixel 100G display green colors.

At the same time, the control circuit 20 can provide first driving signals to a first portion of the mini-pixels RUX in the red sub-pixel 100R, so as to make the first portion of the mini-pixels RUX in the red sub-pixel 100R display red colors. In addition, the control circuit 20 can provide second driving signals to a second portion of the mini-pixels RUX in the red sub-pixel 100R, so as to make the second portion of the mini-pixels RUX in the red sub-pixel 100R display black colors.

At the same time, the control circuit 20 can provide the first driving signals to the first portion of the mini-pixels BUX in the blue sub-pixel 100B, so as to make the first portion of the mini-pixels BUX in the blue sub-pixel 100B display blue colors. In addition, the control circuit 20 can provide the second driving signals to a second portion of the mini-pixels BUX in the blue sub-pixel 100B, so as to make the second portion of the mini-pixels BUX in the blue sub-pixel 100B display black colors.

At the same time, the control circuit 20 can make all of the mini-pixels WUX in the white sub-pixel 100W display black colors.

Through such operation, the red colors displayed by the red sub-pixel 100R, the blue colors displayed by the blue sub-pixel 100B, and the green colors displayed by the green sub-pixel 100G are mixed to form a light green color with a reflectivity higher than reflectivities of the green colors displayed by the green sub-pixel 100G. That is, by using the red sub-pixel 100R and blue sub-pixel 100B to display the red and blue colors, the brightness and the reflectivity of the green color displayed by the pixel 100 can be effectively increased. Therefore, even if the color reflective display device 1 has color filters 150R, 150G, 150B with high PFFs, the color reflective display device 1 can still display an image with a high reflectivity.

In the following paragraphs, to allow the disclosure to be more fully understood, operative embodiments are provided. However, the disclosure is not limited to the operative embodiments described below. In one operative embodiment, the control circuit 20 provides the third driving signals to all of the mini-pixels GUX in the green sub-pixel 100G, to make the portions of the reflective display layer corresponding to all of the mini-pixels GUX in the green sub-pixel 100G display a brightness corresponding to the whitest grayscale (e.g., grayscale "15"), so as to make all of the mini-pixels GUX display green colors. At the same time, the control circuit 20 provides the first driving signals to the first portion of the mini-pixels RUX in the red sub-pixel 100R (e.g., the mini-pixels corresponding to coordinates (−2, 3), (−3, 2), (−2, −2), (−1, 2), (−2, 1)), to make a portion of the reflective display layer corresponding to the mini-pixels RUX receiving the first driving signals display a particular brightness related to a particular grayscale (e.g., grayscale "12" or other grayscale except the grayscale "0"), so as to make the mini-pixels RUX in the first portions display red colors. At the same time, the control circuit 20 provides the second driving signals to the second portion of the mini-pixels RUX in the red sub-pixel 100R (e.g., the mini-pixels corresponding to coordinates (−3, 3), (−3, 1), (−1, 3), (−1, 1)), to make a portion of the reflective display layer corresponding to the mini-pixels RUX receiving the second driving signals display a brightness related to the darkest grayscale (e.g., a grayscale "0"), so as to make the mini-pixels RUX in the first portions display black colors.

In addition, at the same time, the control circuit 20 provides the first driving signals to the first portion of the mini-pixels BUX in the blue sub-pixel 100B (e.g., the mini-pixels corresponding to coordinates (2, −1), (1, −2), (2, −2), (3, −2), (2, −3)), to make a portion of the reflective display layer 140 corresponding to the first portion of the mini-pixels BUX receiving the first driving signals display a particular brightness related to a particular grayscale (e.g., grayscale "12" or another grayscale except for grayscale "0"), so as to make the mini-pixels BUX in the first portions display blue colors. At the same time, the control circuit 20 provides the second driving signals to the second portion of the mini-pixels BUX in the blue sub-pixel 100B (e.g., the mini-pixels corresponding to coordinates (1, −1), (1, −3), (3, −1), (3, −3)), to make a portion of the reflective display layer 140 corresponding to the second portion of the mini-pixels BUX receiving the second driving signals display a brightness related to the darkest grayscale (e.g., a grayscale "0") so as to make the mini-pixels BUX in the second portions display black colors.

Moreover, at the same time, the control circuit 20 can make all of the mini-pixels WUX in the white sub-pixel 100W display black colors.

Through such operation, by using the red sub-pixel 100R and the blue sub-pixel 100B to partly display red colors and partly display blue colors respectively, the brightness and the reflectivity of the green color displayed by the pixel 100 can effectively increased. Thus, even if the color reflective display device 1 has color filters 150R, 150G, 150B with high PFFs, the color reflective display device 1 can still display an image with a high reflectivity.

It is noted that although the first portions of the mini-pixels RUX, BUX receiving the first driving signals and the second portions of the mini-pixels RUX, BUX receiving the second driving signals in the embodiment above are evenly distributed in the red sub-pixel 100R and the blue sub-pixel 100B, other distributions are also possible. The present disclosure is not limited to the embodiment above.

In addition, in the embodiment above, the brightness and the reflectivity of the green color displayed by the pixel 100 are increased by using both of the red and the blue sub-pixels 100G, 100B displaying the red and blue colors. However, in practice, the brightness and the reflectivity of the green color displayed by the pixel 100 can be increased by using one of the red and the blue sub-pixels 100G, 1006 displaying the red or blue color, and the present disclosure is not limited to the embodiment above.

Moreover, in the embodiment above, the grayscales given are for illustrative purposes. In practice, the grayscales of the reflective display layer 140 can be varied on the basis of actual requirements, and the disclosure is not limited to the embodiment above.

Furthermore, in the embodiment above, due to the chromatic characteristics, when the color reflective display device 1 displays a green color through the operation mentioned above, the increases in the reflectivity and the brightness are significant. However, the disclosure is not limited to the embodiment above.

In the embodiment above, the first portion of the mini-pixels RUX, BUX receiving the first driving signals are arranged in a cross shape and are adjacent to each other, and the second portion of the mini-pixels RUX, BUX receiving the second driving signals are not adjacent to each other. However, in practice, the arrangement of the mini-pixels RUX, BUX in the first and second portions can be varied on the basis of actual requirements, and the disclosure is not limited to the embodiment above.

Figure 3A:
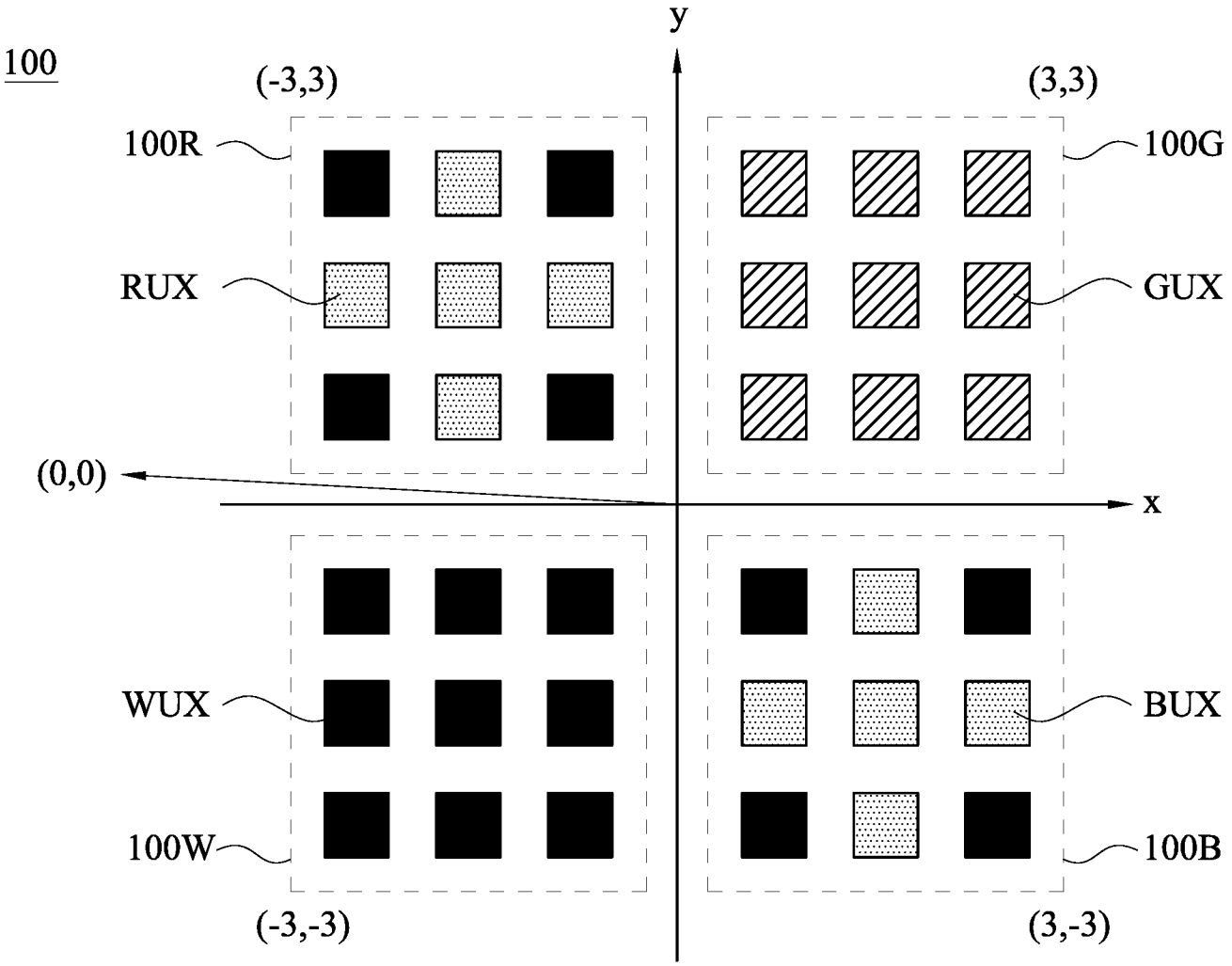
FIG. 3A illustrates a pixel of the color reflective display device in accordance with one operative embodiment of the present disclosure.
Figure 3B:
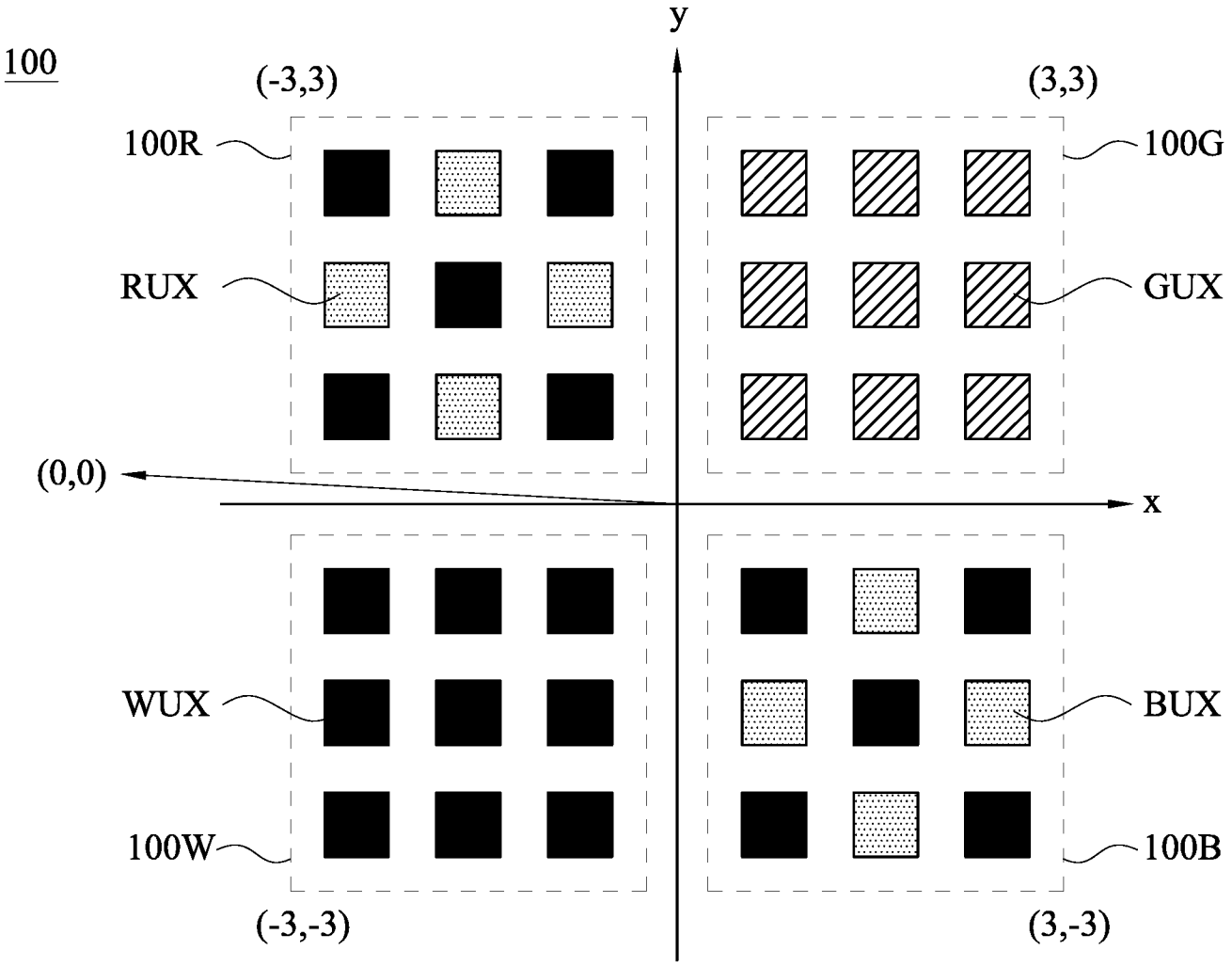
FIG. 3B illustrates a pixel of the color reflective display device in accordance with another operative embodiment of the present disclosure.

Referring to FIG. 3B, in one embodiment of the present disclosure, the first portion of the mini-pixels RUX receiving the first driving signals correspond to coordinates (−2, 3), (−3, 2), (−1, 2), (−2, 1), and the second portion of the mini-pixels RUX receiving the second driving signals correspond to coordinates (−3, 3), (−3, 1), (−1, 3), (−1, 1), (−2, 2). On the other hand, the first portion of the mini-pixels BUX receiving the first driving signals correspond to coordinates (2, −1), (1, −2), (3, −2), (2, −3), and the second portion of the mini-pixels BUX receiving the second driving signals correspond to coordinates (1, −1), (1, −3), (3, −1), (3, −3), (2, −2).

It is noted that, in the embodiment above, the first portions of the mini-pixels RUX, BUX used to receive the first driving signals are not adjacent to each other, and also, the second portions of the mini-pixels RUX, BUX used to receive the second driving signals are not adjacent to each other. Moreover, in the embodiment above, the first and second portions of the mini-pixels RUX, BUX used to receive the first and second driving signals are evenly distributed in the red and blue sub-pixels 100R, 100B.

Figure 3C:
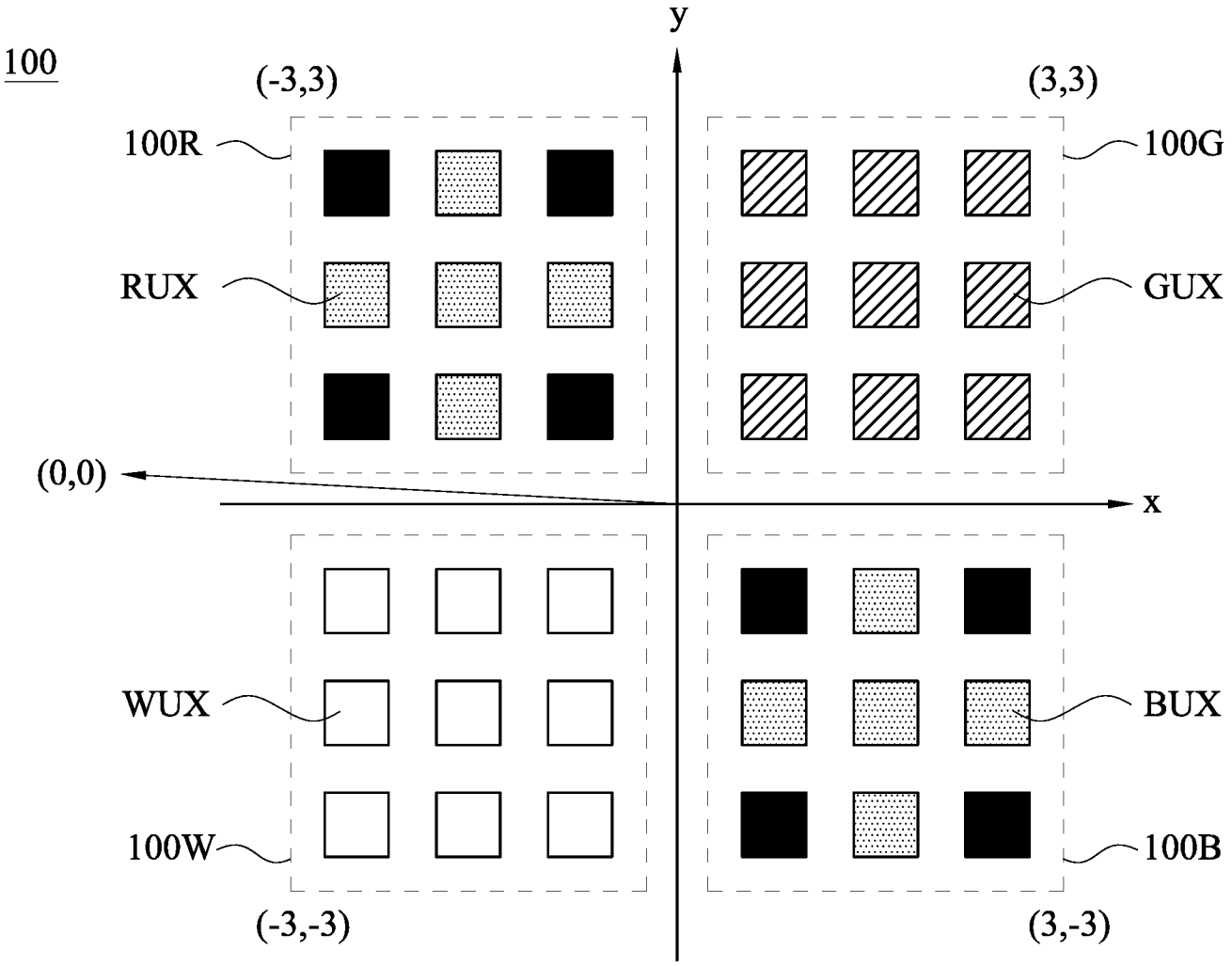
FIG. 3C illustrates a pixel of the color reflective display device in accordance with another operative embodiment of the present disclosure.

Referring to FIG. 3C, in one embodiment of the present disclosure, to make the pixel 100 display a green color with high brightness, the control circuit 20 can provide the third driving signal to all of the mini-pixels GUX in the sub-pixel 100G, and provide the first driving signal to the first portions of the mini-pixels RUX, BUX in the sub-pixels 100R, 100B, and further provide a fourth driving signal to all of the mini-pixels WUX in the white sub-pixel 100W so as to make a portion of the reflective display layer corresponding to the mini-pixels WUX display a white color (e.g., the white particles are located at the viewing surface), and make all of the mini-pixels WUX in the white sub-pixel 100W display white colors.

By using the white sub-pixel 100W to display the white color and using the red sub-pixel 100R and blue sub-pixel 100B to display the red and blue colors, the brightness and the reflectivity of the green color displayed by the pixel 100 can be effectively increased. Therefore, even if the color reflective display device 1 has color filters 150R, 150G, 150B with high PFFs, the color reflective display device 1 can still display an image with a high reflectivity.

In accordance with one embodiment of the present disclosure, the number of the mini-pixels receiving the first and second driving signals can be adjusted according to the actual operating state (e.g., according to the ambient light), such that the brightness and the reflectivity of the green color displayed by the pixel 100 can be adjusted.

For example, in a first operating state (e.g., the ambient light is weak), in addition to providing the third driving signal to all of the mini-pixels GUX in the green sub-pixel 100G, the control circuit 20 can further provide the first driving signals to the first portions of the mini-pixels RUX, BUX shown in FIG. 3A to make the first portions of the mini-pixels RUX, BUX display the red and blue colors, and provide the second driving signals to the second portions of the mini-pixels RUX, BUX shown in FIG. 3A to make the second portions of the mini-pixels RUX, BUX display the black colors.

On the other hand, in a second operating state (e.g., the ambient light is strong), in addition to providing the third driving signals to all of the mini-pixels GUX, the control circuit 20 can further provide the first driving signals to the first portions of the mini-pixels RUX, BUX shown in FIG. 3B to make the first portions of the mini-pixels RUX, BUX display the red and blue colors, and provide the second driving signals to the second portions of the mini-pixels RUX, BUX shown in FIG. 3B to make the second portions of the mini-pixels RUX, BUX display the black colors.

Since the number of the mini-pixels RUX, BUX receiving the first driving signals in the first operating state (e.g., 10) is more than the number of the mini-pixels RUX, BUX receiving the first driving signals in the second operating state (e.g., 8), and the number of the mini-pixels RUX, BUX receiving the second driving signals in the first operating state (e.g., 8) is less than the number of the mini-pixels RUX, BUX receiving the second driving signals in the second operating state (e.g., 10), the brightness and the reflectivity of the green color displayed by the pixel 100 in the first operating state are higher than the brightness and the reflectivity of the green color displayed by the pixel 100 in the second operating state. On the other hand, the color saturation of the green color displayed by the pixel 100 in the second operating state is higher than the color saturation of the green color displayed by the pixel 100 in the first operating state.

Through the operations mentioned above, by switching between the first operating state and the second operating state (i.e., adjusting the number of the mini-pixels receiving the first driving signals), the color reflective display device 1 can display an image with a high color saturation when the ambient light is strong and display an image with a high reflectivity when the ambient light is weak. In such a manner, the color reflective display device 1 can be used more widely.

It is noted that, in the embodiment mentioned above, the first and second portions of the mini-pixels RUX, BUX shown in FIGS. 3A and 3B are taken as a descriptive example. In practice, the number of the mini-pixels receiving the first and second driving signals in the first and second operating states can be varied on the basis of actual requirements, and the disclosure is not limited to the embodiment described above.

In one embodiment of the present disclosure, the control circuit 20 can selectively provide the fourth driving signals to the mini-pixels WUX in the white sub-pixel 100W according to the actual operating state (e.g., according to the ambient light), so as to adjust the brightness and the reflectivity of the green color displayed by the pixel 100.

For example, in a first operating state e.g., the ambient light is strong), in addition to providing the third driving signals to all of the mini-pixels GUX in the green sub-pixel 100G, the control circuit 20 can further provide the second driving signals to all of the mini-pixels RUX, BUX in the red and blue sub-pixels 100R, 100B, to make all of the mini-pixels RUX, BUX in the red and blue sub-pixels 100R, 1006 display black colors.

On the other hand, in a second operating state (e.g., the ambient light is weak), in addition to providing the third driving signals to all of the mini-pixels GUX in the green sub-pixel 100G, the first driving signals to the first portions of the mini-pixels RUX, BUX shown in FIG. 3C, and the second driving signals to the second portions of the mini-pixels RUX, BUX shown in FIG. 3C, the control circuit 20 can further provide the fourth driving signals to all of the mini-pixels WUX in the white sub-pixel 100W, so as to make all of the mini-pixels WUX in the white sub-pixel 100W display white colors.

Through such operation, in the second operating state, the green color displayed by the pixel 100 has higher brightness and the reflectivity. In the first operating state, the green color displayed by the pixel 100 has a higher color saturation. Therefore, the color reflective display device 1 can display an image with a high color saturation when the ambient light is strong and display an image with a high reflectivity when the ambient light is weak. In such a manner, the color reflective display device 1 can be used more widely. It is noted that the display statues of the pixel 100 (e.g., the display statues of the mini-pixels therein) in the first and second operating states can be varied on the basis of actual requirements, and the disclosure is not limited to the embodiment above.

Through one aspect of the present disclosure, the reflectivity of the image displayed by the color reflective display device 1 can be increased without changing the PFFs of the color filters 150R, 150G, 150B thereof.

In one exemplary embodiment, the PFFs of the color filters 150R, 150G, 150B of the reflective color display device 1 are 87. Under CIE standard illuminant D65, when all of the mini-pixels GUX in the green sub-pixel 100G display green colors, all of the mini-pixels WUX in the white sub-pixel 100W display white colors, a part of the mini-pixels RUX in the red sub-pixel 100R and a part of the mini-pixels BUX in the blue sub-pixel 100B display red and blue colors, and the other mini-pixels RUX in the red sub-pixel 100R and the other mini-pixels BUX in the blue sub-pixel 100B display black colors, the CIE color coordinate values corresponding to the color displayed by the reflective color display device 1 are measured as a*=−9.79, b*=4.79, and L*=44.21.

Thus, compared with the CIE color coordinate values in Table 1, through one aspect of the configuration mentioned above, the reflectivity of the reflective color display device 1, which has the color filters 150R, 150G, 150B with PFFs 87, can be increased without changing the color filters therein.

Moreover, in the exemplary embodiment above, when displaying a light green color, the CIE color coordinate value L*=44.21 corresponding to such a light green color is higher than the CIE color coordinate value L*=43.17 in the third row of Table 1, and the CIE color coordinate values a:=−9.79 and b*=4.79 corresponding to this light green color are similar to the CIE color coordinate values a*=−10.86 and b*=5.31 in the third row of Table 1. In addition, when the reflective color display device 1 displays the normal green color (that is, all of the mini-pixels GUX in the green sub-pixel 100G display green colors, and all of the mini-pixels WUX, RUX, BUX in the white, red blue sub-pixels 100W, 100R, 100 display black colors), the CIE color coordinate values corresponding to such a normal green color is identical to the CIE color coordinate values in the first row of Table 1 (since the PFFs of the color filters are 87).

Thus, through one aspect of the configuration above mentioned, the reflective color display device 1 can have a high reflectivity (e.g., corresponding to the CIE color coordinate L*=44.21) and a high color saturation (e.g., corresponding to the CIE color coordinates a*=−17.83, b*=11.5).

Figure 4:
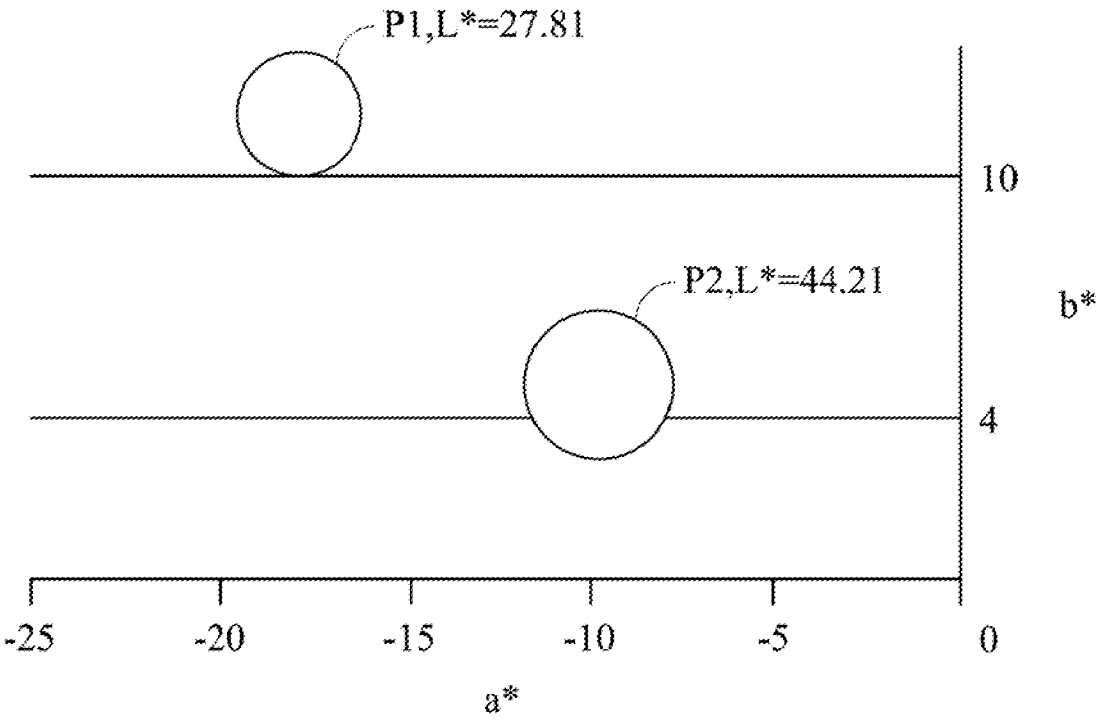
FIG. 4 illustrates positions in the CIELAB coordinate system corresponding to green colors displayed by the reflective color display device 1 in accordance with one embodiment of the present disclosure.

Reference is now made to FIG. 4. Point P1 indicates a position in the CIELAB coordinate system corresponding to a normal green color displayed by the reflective color display device 1 in accordance with one embodiment of the present disclosure, in which the coordinate values are L*=27.81, a*=−17.83, b*=11.5 (identical to the values in the first row of Table 1). Point P2 indicates a position in the CIELAB coordinate system corresponding to a light green color displayed by the reflective color display device 1 in accordance with one embodiment of the present disclosure, in which the coordinate values are L*=44.21, a*=−9.79, b*=4.79. By the operations mentioned above, the position in the CIELAB coordinate system corresponding to the colors displayed by the reflective color display device 1 can be adjusted between points P1 and P2, but the present disclosure is not limited in this regard.

Figure 5:
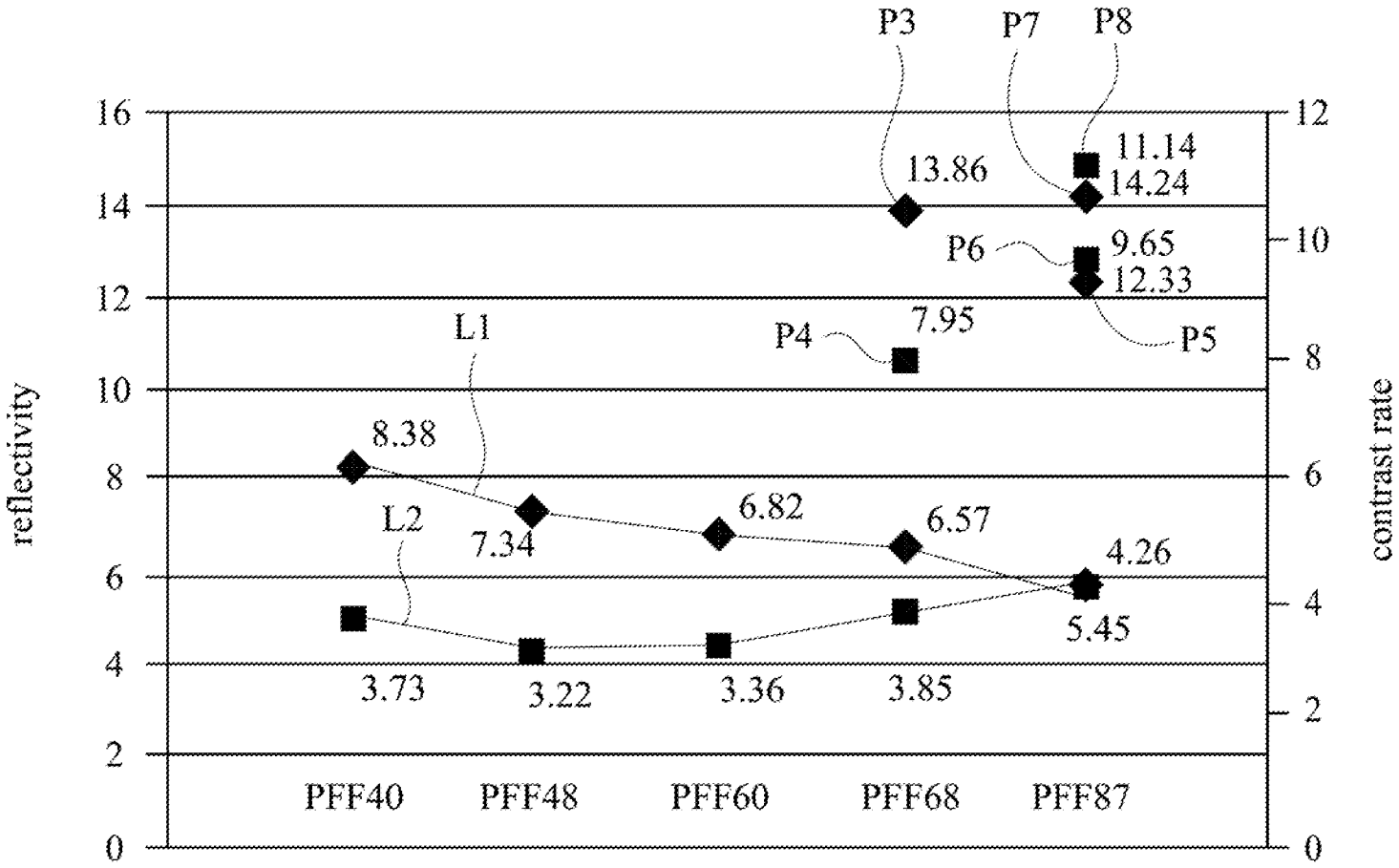
FIG. 5 illustrates reflectivities and maximal contrast ratios of color reflective display devices which have color filters with different PFFs.

Reference is now made to FIG. 5. FIG. 5 illustrates the reflectivities and the maximal contrast ratios (i.e., the contrast ratios between the (light) green colors and the black colors) of color reflective display devices which have color filters with different PFFs.

Line L1 indicates the reflectivities of the green colors displayed by the color reflective display devices which have color filters with different PFFs.

Line L2 indicates the contrast ratios between the green colors and the black colors of the color reflective display devices which have color filters with different PFFs.

Point P3 indicates the reflectivity corresponding to a light green color displayed by a color reflective display device having color filters with PFFs 68 when the green sub-pixel displays a green color and the white sub-pixel displays a white color.

Point P4 indicates the contrast ratio between a light green color and a black color displayed by a color reflective display device having color filters with PFFs 68, in which the light green color is displayed by the green and white sub-pixels of the color reflective display device displaying green and white colors.

Point P5 indicates the reflectivity corresponding to a light green color displayed by a color reflective display device having color filters with PFFs 87 when the green sub-pixel displays a green color and the white sub-pixel displays a white color.

Point P6 indicates the contrast ratio between a light green color and a black color displayed by a color reflective display device having color filters with PFFs 87, in which the light green color is displayed by the green and white sub-pixels of the color reflective display device displaying green and white colors.

Point P7 indicates the reflectivity corresponding to a light green color displayed by a color reflective display device having color filters with PFFs 87 when the green sub-pixel displays a green color, the white sub-pixel displays a white color, a part of the red and blue mini-pixels display red and blue colors, and the other red and blue mini-pixels display a black color.

Point P8 indicates the contrast ratio between a light green color and a black color displayed by a color reflective display device having color filters with PFFs 87, in which the light green color is displayed by the green and white sub-pixels of the color reflective display device displaying green and white colors, a part of the mini-pixels RUX, BUX in the red and blue sub-pixel display red and blue colors and the other mini-pixels RUX, BUX in the red and blue sub-pixel display black colors.

Notably, according to points P7, P8 and lines L1, L2, through one aspect of the configuration mentioned above, the reflectivity and the maximal contrast ratio can be effectively increased without changing the color filters (e.g., the reflectivity is increased from 5.45 to 14.24, and the maximal contrast ratio is increased from 4.26 to 11.14). In such a manner, the color reflective display device 1 can be used more widely.

Another aspect of the present disclosure is related to an operating method. The operating method can be applied to a color reflective display device having a structure that is the same as or similar to the structure shown in FIG. 1 and FIG. 2. To simplify the description below, in the following paragraphs, the embodiments shown in FIG. 1 and FIG. 2 will be used as an example to describe the operating method according to an embodiment of the present disclosure. However, the invention is not limited to application to the embodiments shown in FIGS. 1 and 2.

In addition, it should be noted that in the steps of the following operating method, no particular sequence is required unless otherwise specified. Moreover, the following steps also may be performed simultaneously or the execution times thereof may at least partially overlap.

Furthermore, the steps of the following operating method may be added to, replaced, and/or eliminated as appropriate, in accordance with various embodiments of the present disclosure.

Figure 6:
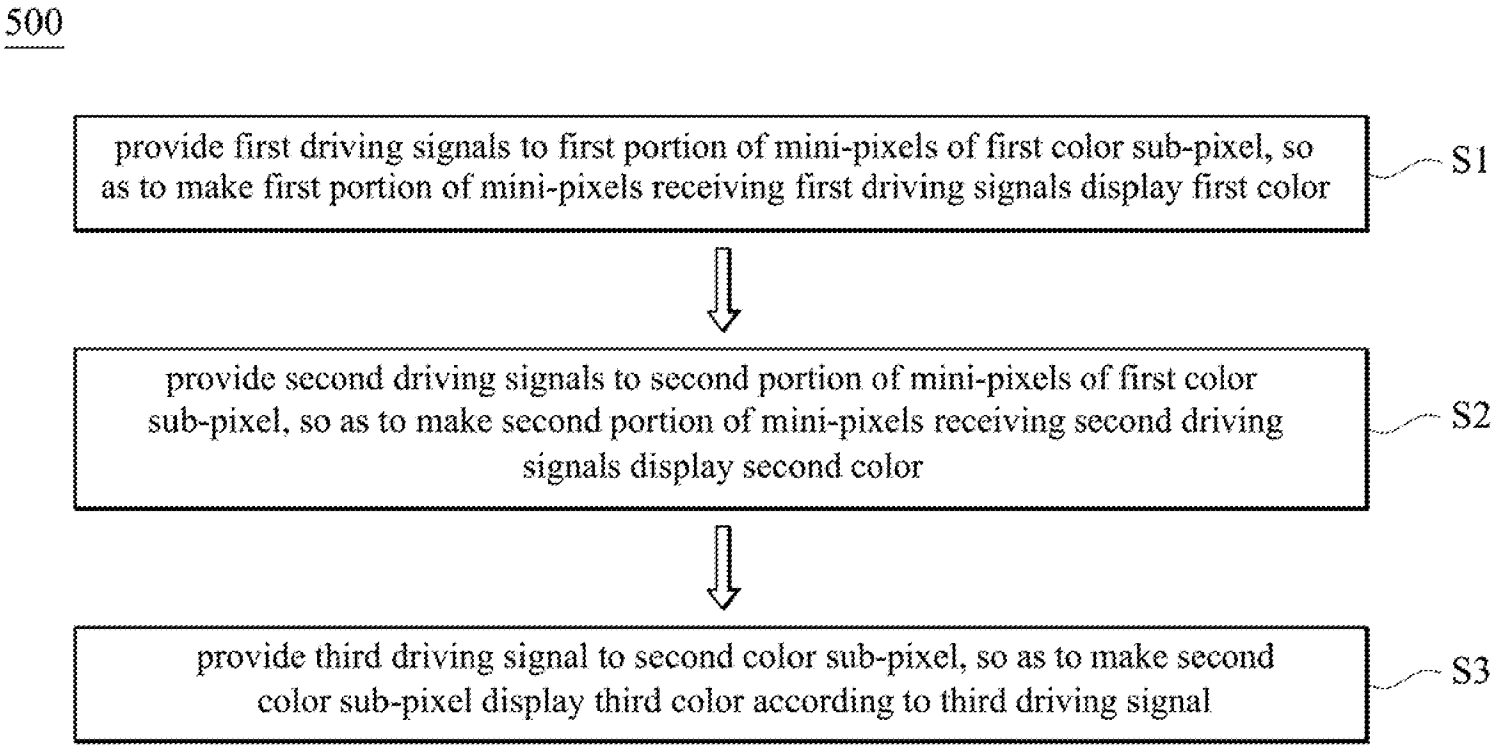
FIG. 6 is a flowchart of an operating method in accordance with one embodiment of the present disclosure.

FIG. 6 is a flowchart of an operating method 500 in accordance with one embodiment of the present disclosure. The operating method 500 includes the steps outlined below.

In step S1, the control circuit 20 provides a first driving signal to at least one of the mini-pixels of the first color sub-pixel through the scan circuit 30 and data circuit 40 via the scan lines 32 and the data lines 42, so as to make the at least one mini-pixel receiving the first driving signal display a first color. For example, the first color sub-pixel is one of the red sub-pixel 100R, the blue sub-pixel 100B, and the green sub-pixel. The first color is one of the red, green, and blue colors.

In step S2, the control circuit 20 provides a second driving signal to at least another one of the mini-pixels of the first color sub-pixel through the scan circuit 30 and data circuit 40 via the scan lines 32 and the data lines 42, so as to make the at least another one of the mini-pixels receiving the second driving signal display a second color different from the first color. For example, the second color is a black color.

In step S3, the control circuit 20 provides a third driving signal to the second color sub-pixel through the scan circuit 30 and data circuit 40 via the scan lines 32 and the data lines 42, so as to make the second color sub-pixel display a third color according to the third driving signal. For example, the second color sub-pixel is another one of the red sub-pixel 100R, the blue sub-pixel 100B, and the green sub-pixel. The third color is another one of the red, green, and blue colors.

Through such operation, when all of the mini-pixels GUX in the green sub-pixel 100G display green colors, the brightness and the reflectivity of the green color displayed by the pixel 100 can effectively increased by using the red sub-pixel 100R and the blue sub-pixel 100B to partly display red colors and partly display blue colors respectively. Thus, even if the color reflective display device 1 has color filters 150R, 150G, 150B with high PFFs, the color reflective display device 1 can still display an image with a high reflectivity.

Details of the operating method 500 can be ascertained by referring to the paragraphs above, and a description in this regard will not be repeated herein.

Although the present invention has been described in considerable detail with reference to certain embodiments thereof, other embodiments are possible. Therefore, the scope of the appended claims should not be limited to the description of the embodiments contained herein.

What is claimed is:

1. A color reflective display device comprising:

a plurality of color sub-pixels, wherein a first color sub-pixel of the color sub-pixels comprises a first color filter and a plurality of mini-pixels located under the first color filter, wherein each of the mini-pixels comprises a reflective display layer, and the reflective display layer only includes a plurality of white particles and a plurality of black particles; and a control circuit, wherein, in a first operating state, the control circuit provides a first driving signal to at least one of the mini-pixels of the first color sub-pixel to locate the white particles on a viewing surface of the reflective display layer to display a first color through the first color filter according to the first driving signal;

the control circuit provides a second driving signal to another at least one of the mini-pixels of the first color sub-pixel to locate the black particles on the viewing surface of the reflective display layer to display a second color through the first color filter according to the second driving signal, wherein the second color is different from the first color; and the control circuit provides a third driving signal to a second color sub-pixel of the color sub-pixels to locate the white particles on the viewing surface of the reflective display layer, such that the second color sub-pixel displays a third color according to the third driving signal, wherein the first color is one of three primary colors, the third color is another one of the three primary colors and the second color is black color, and the first color and the second color are used to adjust reflectivity of the third color.

2. The color reflective display device as claimed in claim 1, wherein a reflectivity of a fourth color mixed by the first color, the second color, and the third color is higher than the reflectivity of the third color.

3. The color reflective display device as claimed in claim 1, wherein a third color sub-pixel of the color sub-pixels comprises a plurality of mini-pixels, and the control circuit is configured to, in the first operating state, provide the first driving signal to at least one of the mini-pixels of the third color sub-pixel, such that the at least one of the mini-pixels of the third color sub-pixel receiving the first driving signal displays a sixth color according to the first driving signal, and provide the second driving signal to another at least one of the mini-pixels of the third color sub-pixel, such that the another at least one of the mini-pixels of the third color sub-pixel receiving the second driving signal displays a seventh color different from the sixth color according to the second driving signal.

4. The color reflective display device as claimed in claim 3, wherein the first color is one of red, green, and blue, the sixth color is another one of red, green, and blue, and the third color is the remaining one of red, green, and blue.

5. The color reflective display device as claimed in claim 3, wherein the second color sub-pixel is a green sub-pixel, the first color sub-pixel is one of a red sub-pixel and a blue sub-pixel, and the third color sub-pixel is another one of the red sub-pixel and the blue sub-pixel.

6. The color reflective display device as claimed in claim 1, wherein in a situation where there is more than one of the mini-pixels receiving the first driving signal in the first color sub-pixel, the mini-pixels receiving the first driving signal are evenly disposed in the first color sub-pixel.

7. The color reflective display device as claimed in claim 1, wherein, in a second operating state, the control circuit provides the first driving signal to at least one of the mini-pixels of the first color sub-pixel, such that the at least one of the mini-pixels of the first color sub-pixel receiving the first driving signal to locate the white particle on a viewing surface of the reflective display layer to display the first color through the first color filter according to the first driving signal, and wherein a number of the mini-pixel receiving the first driving signal to display the first color in the first operating state is different from a number of the mini-pixel receiving the first driving signal to display the first color in the second operating state, such that a reflectivity of a fourth color mixed by the first color, the second color, and the third color in the first operating state is different from a reflectivity of a fifth color mixed by the first color, the second color, and the third color in the second operating state, wherein the control circuit is configured to determine whether to function in the first operating state or the second operating state according to an ambient light.

8. The color reflective display device as claimed in claim 1, wherein the control circuit is further configured to provide a fourth driving signal to a fourth color sub-pixel during providing the first driving signal and the second driving signal to the first color sub-pixel, such that the fourth color sub-pixel displays an eighth color according to the fourth driving signal.

9. The color reflective display device as claimed in claim 8, wherein the eighth color is white.

10. An operating method of a color reflective display device, wherein the color reflective display device comprises a first color sub-pixel, and the first color sub-pixel comprises a fist color filter and a plurality of mini-pixels under the first color filter, the operating method comprising:

providing, in a first operating state, a first driving signal to at least one of the mini-pixels of the first color sub-pixel, wherein each of the mini-pixels comprises a reflective display layer, and the reflective display layer only has a plurality of white particles and black particles, and the first driving signal is provided to locate the white particles on a viewing surface of the reflective display layer to display a first color through the first color filter according to the first driving signal;

providing, in the first operating state, a second driving signal to another at least one of the mini-pixels of the first color sub-pixel to locate the black particles on the viewing surface of the reflective display layer to display a second color through the first color filter according to the second driving signal, wherein the second color is different from the first color; and providing, in the first operating state, a third driving signal to a second color sub-pixel of the color sub-pixels to locate the white particles on the viewing surface of the reflective display layer such that the second color sub-pixel displays a third color according to the third driving signal, wherein the first color is one of three primary colors, the third color is another one of the three primary colors and the second color is black color, and the first color and the second color are used to adjust reflectivity of the third color.

11. The operating method as claimed in claim 10, wherein the reflectivity of fourth color mixed by the first color, the second color, and the third color is higher than a reflectivity of the third color.

12. The operating method as claimed in claim 10, wherein a third color sub-pixel of the color sub-pixels comprises a plurality of mini-pixels, the operating method comprising:

providing, in the first operating state, the first driving signal to at least one of the mini-pixels of the third color sub-pixel, such that the at least one of the mini-pixels of the third color sub-pixel receiving the first driving signal displays a sixth color according to the first driving signal; and providing, in the first operating state, the second driving signal to another at least one of the mini-pixels of the third color sub-pixel, such that the another at least one of the mini-pixels of the third color sub-pixel receiving the second driving signal displays a seventh color different from the sixth color according to the second driving signal.

13. The color reflective display device as claimed in claim 12, wherein the first color is one of red, green, and blue, the sixth color is another one of red, green, and blue, and the third color is the remaining one of red, green, and blue.

14. The color reflective display device as claimed in claim 12, wherein the second color sub-pixel is a green sub-pixel, the first color sub-pixel is one of a red sub-pixel and a blue sub-pixel, and the third color sub-pixel is another one of the red sub-pixel and the blue sub-pixel.

15. The operating method as claimed in claim 10, wherein in a situation where there is more than one of the mini-pixels receiving the first driving signal in the first color sub-pixel, the mini-pixels receiving the first driving signal are evenly disposed in the first color sub-pixel.

16. The operating method as claimed in claim 10, further comprising:

providing, in a second operating state, the first driving signal to at least one of the mini-pixels of the first color sub-pixel, such that the at least one of the mini-pixels of the first color sub-pixel receiving the first driving signal to locate the white particles on a viewing surface of the reflective display layer to display the first color through the first color filter according to the first driving signal, wherein a number of the mini-pixel receiving the first driving signal to display the first color in the first operating state is different from a number of the mini-pixel receiving the first driving signal to display the first color in the second operating state, such that a reflectivity of a fourth color mixed by the first color, the second color, and the third color in the first operating state is different from a reflectivity of a fifth color mixed by the first color, the second color, and the third color in the second operating state, wherein whether to function in the first operating state or the second operating state is determined according to an ambient light.

17. The operating method as claimed in claim 10 further comprising:

providing a fourth driving signal to a fourth color sub-pixel during providing the first driving signal and the second driving signal to the first color sub-pixel, such that the fourth color sub-pixel displays an eighth color according to the fourth driving signal.

18. The operating method as claimed in claim 17, wherein the eighth color is white.

19. The color reflective display device as claimed in claim 7, wherein the ambient light corresponds to a first intensity when the control circuit is configured to determine to function in the first operating state, the ambient light corresponds to a second intensity when the control circuit is configured to determine to function in the second operating state, and the first intensity is weaker than the second intensity.

20. The operating method as claimed in claim 16, wherein the ambient light corresponds to a first intensity if the first operating state is determined to be functioned in, the ambient light corresponds to a second intensity if the second operating state is determined to be functioned in, and the first intensity is weaker than the second intensity.

* * * * *